United States Patent [19]

Strehlow

[11] Patent Number: 4,963,032

[45] Date of Patent: Oct. 16, 1990

[54] DRUM FOR TILT MIXER

[75] Inventor: Robert W. Strehlow, New Berlin, Wis.

[73] Assignee: McNeilus Truck and Manufacturing, Inc., Dodge Center, Minn.

[21] Appl. No.: 482,926

[22] Filed: Feb. 22, 1990

[51] Int. Cl.[5] ..... B28C 5/20

[52] U.S. Cl. ..... 366/57; 366/45

[58] Field of Search ..... 366/45, 46, 54, 55, 366/57, 56, 27, 28, 36, 181, 228, 220, 30; 141/93

[56] References Cited

U.S. PATENT DOCUMENTS

| | | | |
|---|---|---|---|
| 1,994,010 | 3/1935 | Ball | 366/54 |
| 3,429,561 | 2/1969 | Maxon | 366/45 |
| 4,403,865 | 9/1983 | Fejmert | 366/44 |

*Primary Examiner*—Robert W. Jenkins

*Attorney, Agent, or Firm*—Haugen and Nikolai

[57] ABSTRACT

An improved tiltable rotating concrete mixing drum has a relatively flat rear conical charging zone, a front conical zone having a central discharge opening for discharging materials when mixed and a generally cylindrical central zone disposed between front and rear conical zones in which the overall length-to-diameter ratio is reduced. The improved mixing drum has two sets of mixing blades, one in the central or mixing zone and one in the front or discharge zone which is scoop-shaped and configured to increase the efficiency of mixing along the horizontal axis of the drum by increasing the overall mixing efficiency.

11 Claims, 4 Drawing Sheets

DRUM FOR TILT MIXER

CROSS REFERENCE TO RELATED APPLICATIONS

Cross reference is made to two related patent applications by the same inventor, Ser. No. 483,172, and Ser. No. 483,176, filed of even date and assigned to the same assignee as the present application. They involve separate and distinct inventions related to mixing drums for tilt mixers.

BACKGROUND OF THE INVENTION

I. Field of the Invention

The present invention generally pertains to mixing drums for batch style tilt mixers particularly those used to mix erosive materials such as concrete prior to its being loaded into transit carriers including concrete mixer trucks, commonly known as readymix trucks. More specifically, the present invention relates to improvements in the drum design which enhance mixing efficiency.

II. Discussion of Related Art

Tilt mixers having drums of various types have been used for many years in the construction industry for mixing batches of concrete to be loaded into trucks which, in turn, transport the concrete to job sites for placing. Over the years, experience has shown it to be most economical to manufacture tilt mixers themselves in a size capable of being transported by truck over the highways and mounted for use at the mixing plant. Therefore, they must be within the maximum size which can be legally transported on a highway.

Tilt mixers are typically installed in an elevated position so that trucks hauling the pre-mixed materials may be loaded from above by tilting the mixer and discharging the mixed batch through a chute into the charging end of the truck.

Such devices typically are designed to be charged and to conduct the mixing operation in a substantially horizontal position. The charging end of the drum closely addresses a fixed loading chute for receiving measured amounts of aggregate, including sand and stone, cement and water, in the case of concrete, according to the batch formula used. The charging end of the drum must be configured so as to clear the charging chute when the drum is tilted to discharge the mixed materials into the discharge chute for delivery to the site of the pour. The, clearance with respect to the front or discharge end of the mixing drum is also important. Consideration of the height necessary to mount the drum for tilt loading of ready mix trucks and the clearance for the charging chute are important considerations which must be weighed together with the desire to make the drum itself as close as is reasonable to the ideal mixing shape, in which the length is the same as or approaches the diameter of the drum.

Most previous mixing drums of the class described have had to provide a cone with a severe angle to accommodate the charging chute and have generally been shaped with a reduced the diameter with respect to length. They have also had to use a pivot point which is removed some distance from the discharge end of the drum with respect to the axis about which the drum is tilted in order to reduce the torque required to tilt the drum for discharging materials. This had led, to the development of a general configuration for tilt mixer drums which has become somewhat of an industry standard. It includes ends having rather radical conical sections and a rather elongated mixing central zone. The drum is mounted to be pivoted at a distance from the discharge end. The drum itself has to be mounted at a relatively high position in order for the truck loading-unloading chute beneath the discharge end of the mixer to clear the tops of the trucks which drive under the mixer for loading as the loading system must accommodate the mixing drum when fully tilted to discharge the mixed material.

In addition to the need to decrease the length to diameter ratio of the mixing drum itself, the efficiency and uniformity of mixing have left much to be desired with respect to drum agitators. For example, there has existed a need to increase the efficiency or speed of mixing a batch with respect to obtaining proper uniformity from front to back of the mixing drum. While batches having local uniformity can be mixed fairly rapidly, the time required to achieve the desired total uniformity within the batch from front to back of the mixer could be greatly improved. Thus, a need has existed to increase the mixing efficiency of a rotary tilt mixing drum both from the standpoint of the shape of the drum and from the standpoint of improving the effect of the agitation means within the drum to achieve more efficient mixing.

SUMMARY OF THE INVENTION

According to the present invention, an improved rotatory drum is provided for a tilt mixer utilized for mixing erosive materials such as aggregate, cement and sand with water in batching concrete. The drum of the present invention exhibits improved mixing characteristics which make it significantly more efficient than previous drums thereby increasing the throughput of batched materials. Such a drum can be used anywhere concrete materials are mixed, and it is contemplated that the drum of the present invention could be utilized in conjunction with either a permanent or a portable cement mixing plant.

The largest diameter of the drum, which occurs in the central mixing zone, is maximized with respect to generally allowable height for loads transported on highways. In addition, the length of the drum, especially with respect to the conical charge and discharge sections, is minimized to reduce the overall length-todiameter ratio. As stated above, it has been found that as the overall length approaches the drum diameter, mixing characteristics improve. The center of the active mixing zone has been shown to be approximately the same distance from all confining drum surfaces. Thus, the most efficient vessel theoretically is a sphere. In one embodiment of the present invention the overall length has been reduced to less than 1.15 times the diameter. Most conventional mixers have a length-to-diameter ratio greater than 1.35 to 1.

In the preferred embodiment, the rear or charging cone of the drum is of a depth sufficient only for the drum, to clear the fixed charging chute when tilted and the front conical discharging section of the drum is made as snub-nosed as is commensurate with the ability to properly discharge the mixed materials into a discharge hopper clearing the mixer mechanisms.

The preferred embodiment of the drum employs two sets of fixed mixing blades, one set in the central mixing zone and one set in the front conical discharge section, each having a maximum number of blades, normally six, which themselves are specifically configured and placed so that material being mixed is continually being moved from the charging end into the central mixing zone and from the central mixing zone up into the front cone zone and back to the central mixing zone in a manner which substantially decreases the time necessary to thoroughly mix a batch.

The plurality of blades in each set are symmetrically positioned with respect to the longitudinal axis of the drum and fixed to the drum wall. The blades are uniquely shaped and positioned so that they have the effect of continually causing material to move horizontally and be redistributed over the length of the drum thereby reducing the batch mixing time necessary. The blades are preferably scoop-shaped and, in the case of the mixing zone, the blades are generally mounted at an angle perpendicular to the drum wall toward the charging end and the angle is gradually reduced along the length of the blade so that the end furthest into the mixing zone is at an angle of about 45° with the drum wall. The blades are preferably in the general shape of elongated trapezoids in which the parallel sides are the short sides. The longer of the parallel sides, in the case of the central zone blades, is disposed generally toward the charging end. The mixing blades in the front or conical section can be identical with those in the central mixing zone. The front the set of mixing blades is disposed symmetrically with respect to the central discharge opening of the mixer with the longer of the parallel sides disposed toward the central mixing zone.

During the mixing operation, the drum is disposed with the longitudinal axis in a horizontal plane and rotated in one direction. Each blade scoops up material as the drum rotates and the variation in the wall/blade angle together with the decreasing width of the blades of the set in the central mixing zone causes material scooped up by the blades to slide toward the central mixing zone from the charging end. Because the blade narrows as the mass sides forward it starts spilling along the drum as the blade narrows. The configuration in the front or conical zone, in which the large pickup end is directed back toward the mixing zone, causes the material to be forced up into the cone where it slides back along the conical slope as it falls off the blades. This combination produces excellent high-speed front to back mixing.

BRIEF DESCRIPTION OF THE DRAWINGS

In the drawings, wherein like numerals are utilized to designate like parts throughout the same.

DESCRIPTION OF THE PREFERRED EMBODIMENT

Figure 1:
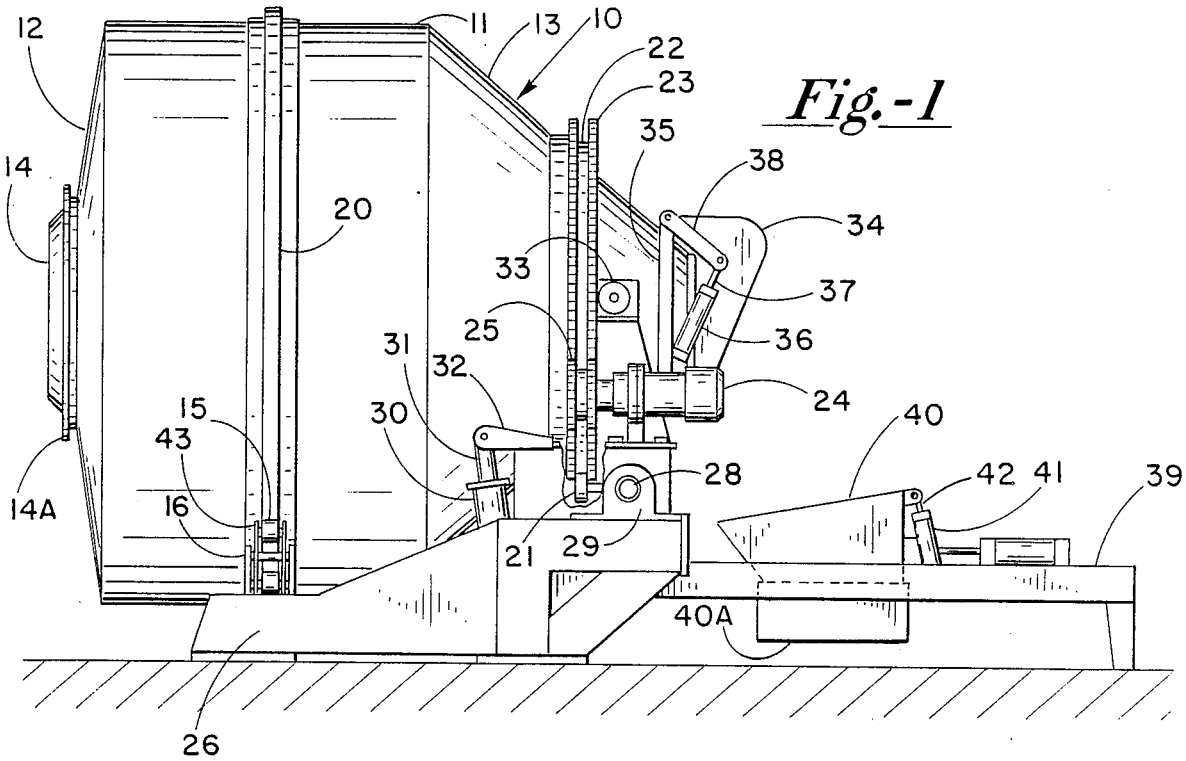
FIG. 1 is a side elevational view of a tilt mixer including the improved mixing drum of the invention disposed in the horizontal or mixing position.

In accordance with the invention, certain improvements in the geometry of the mixing drum and in the shape, number and disposition of the agitator or mixing blades has been found to dramatically increase the mixing efficiency of batch concrete mixing. These improvements will now be described with reference to the drawing figures of a preferred embodiment, which is meant to be illustrative only, demonstrating the principles of the invention.

Figure 2:
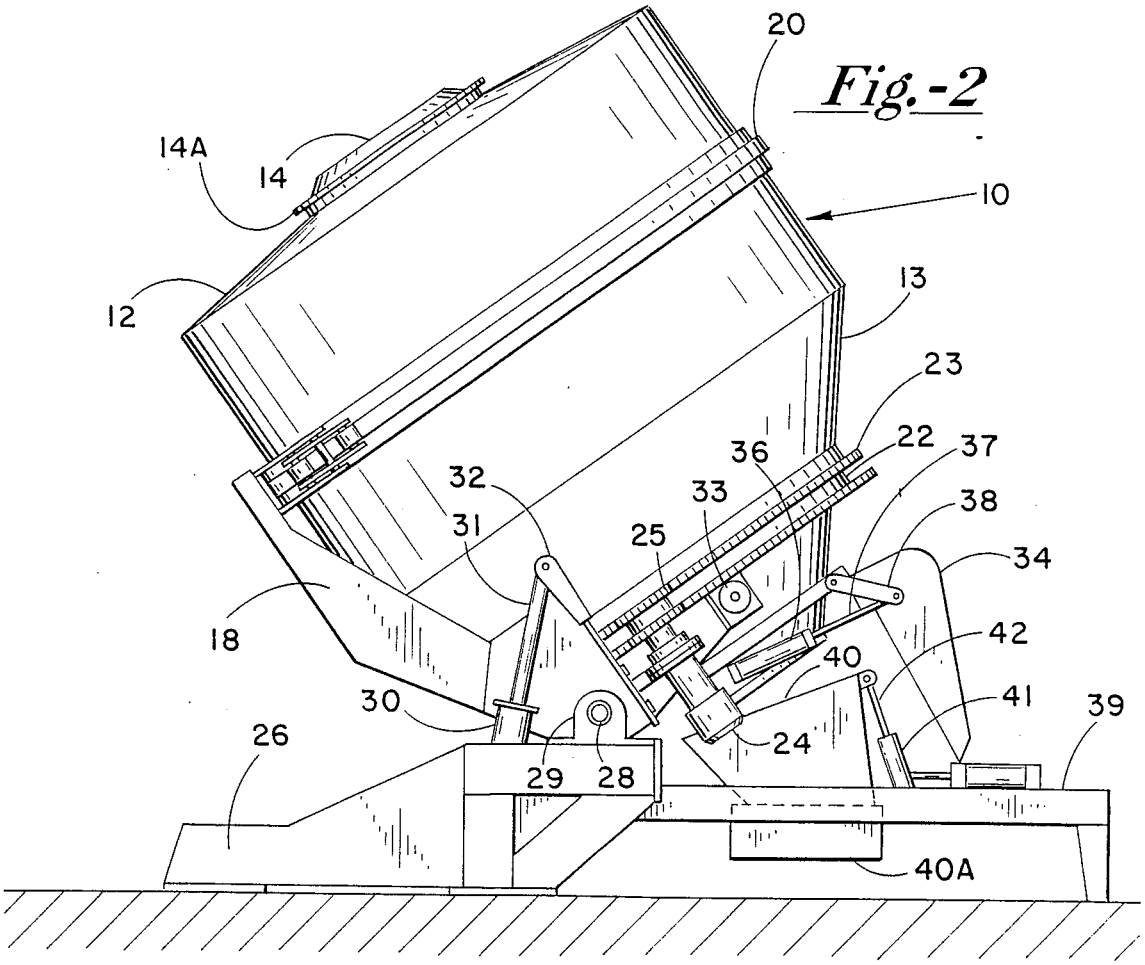
FIG. 2 illustrates the drum of FIG. 1 in a fully tilted or discharging position.
Figure 3:
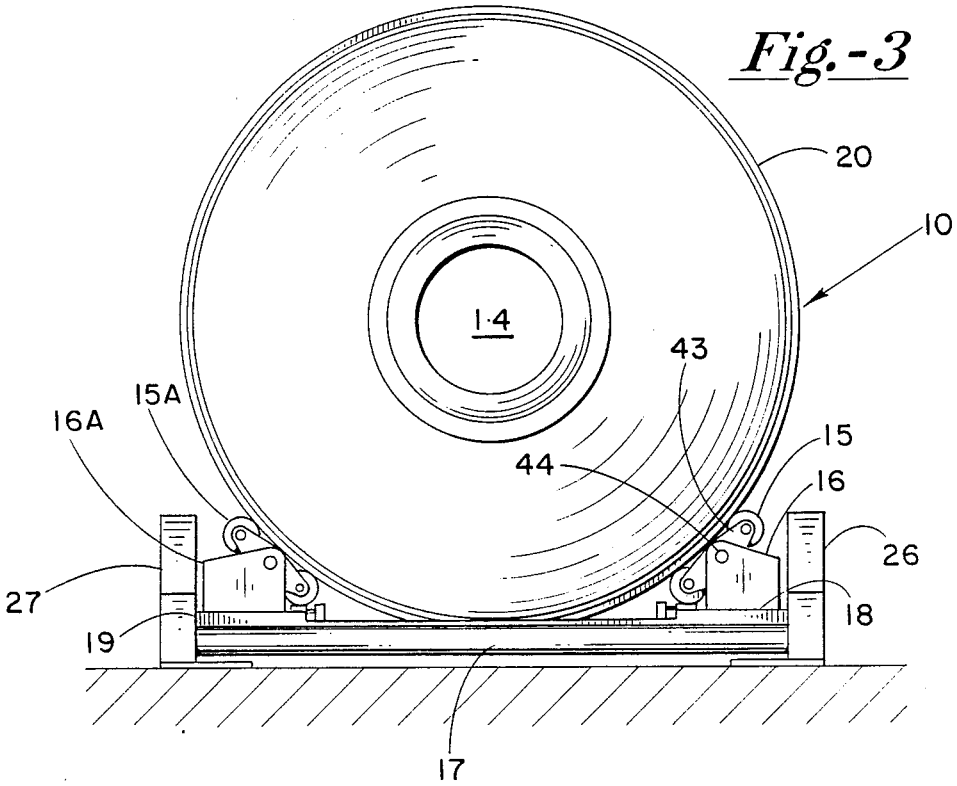
FIG. 3 is a charge end elevational view of the drum of FIG. 1.

FIGS. 1–3 illustrate a tilt mixing apparatus as it might be mounted on an elevated platform, not shown. The mixer includes a rather large diameter drum shown generally at 10 having a generally cylindrical central mixing section 11 flanked by a rear charging section 12 and a front conical section 13. The shallow cone charging section 12 is provided with a central charge opening 14 therein for receiving the materials to be mixed. The charge opening is fitted with an enlarged plastic charging seal 14A to provide an enlarged opening upon removal of the seal to facilitate blade replacement as other internal drum maintenance. The drum 10 is supported for rotation about its longitudinal axis by a dual set of adjustable boggy rollers 15 and **15*a* fixed in rotatable fashion to dual flanges one of each of which is shown at mounting members 16 and 16*a*. The flanges are supported by a cross member 17 which is part of a heavy reinforced tilting frame including side members 18 and 19. The boggy rollers are designed to ride in and follow a drum track 20 which circumscribes the generally cylindrical central mixing section 11. Additional rollers as at 21 (FIG. 1) ride within a track 22 between the rows of teeth of a dual-tooth ring drive gear mounted toward the front of the drum at 23. The drum is adapted to be rotated by a drive system including a pair of synchronous electric motors flanking the front or cone section of the mixing drum one of which is shown at 24. The shaft of each motor is connected to a pair of drive gears, as at 25, each gear of the pair is disposed to address a corresponding row of teeth in the ring gear 23. The teeth in the two rows of the ring gear 23 are preferably staggered or offset with respect to each other to reduce both noise and wear caused by driving the heavy drum 10**.

The tilting operation of the drum involves pivoting the entire drum by raising the frame on which the drum is mounted with respect to its stationary mount represented by fixed mounting members 26 and 27 which flank the members 18 and 19. The pivot point or axis of rotation preferably resides in a relatively large diameter torque tube (illustrated at 50 in the schematic of FIG. 4) which is attached to a pair of heavy flanking longitudinal axles one of which is shown at 28 which are suitably journalled into a pair of heavy bearings mounted on the stationary base members 26 and 27 as illustrated by the pillow block 29. The elevation of the drum 10 is controlled by a pair of fluid operated cylinder systems as illustrated by cylinder 30 with rod 31 which is pivotally mounted to an arm member 32 attached to supporting structural member 26 in a well-known manner. Additional support for the mixing drum 10 while disposed in an elevated state is provided by a plurality of thrust rollers mounted from the movable frame, one of which is shown at 33, which bear against the side of the ring gear thereby maintaining the position of the drum relative to the other support and drive mechanisms during tilting.

The mixing drum may be further provided with an integrally mounted dust hood 34 which is pivotally attached to a similarly shaped shroud member 35 surrounding the discharge opening of the mixing drum. The dust hood 34 is designed to be operated in cooperation with the tilting of the drum and discharging of a mixed batch by an additional fluid cylinder arrangement including cylinder 36, rod 37 and pivot arm 38 in a well-known manner. The opening of the dust hood may be controlled by a suitable electrical interlock with the tilt actuator. The tilt mixer system further includes a discharge chute arrangement mounted on the elevated frame including a frame member 39 and may be in the form of a twostage discharge hopper including telescoped stages 40 and 40*a* shown fully extended and ready to receive mixed materials in FIG. 2. The telescoping discharge chute may also be cylinder operated as illustrated by cylinder 41 and rod 42. The ability of the twostage telescoping discharge hopper to be elevated to meet the discharge end of the mixing drum increases the allowed clearance underneath the frame by allowing the various parts attached to the mixing drum to clear the hopper at a lower level when the discharge hopper is retracted.

Figure 4:
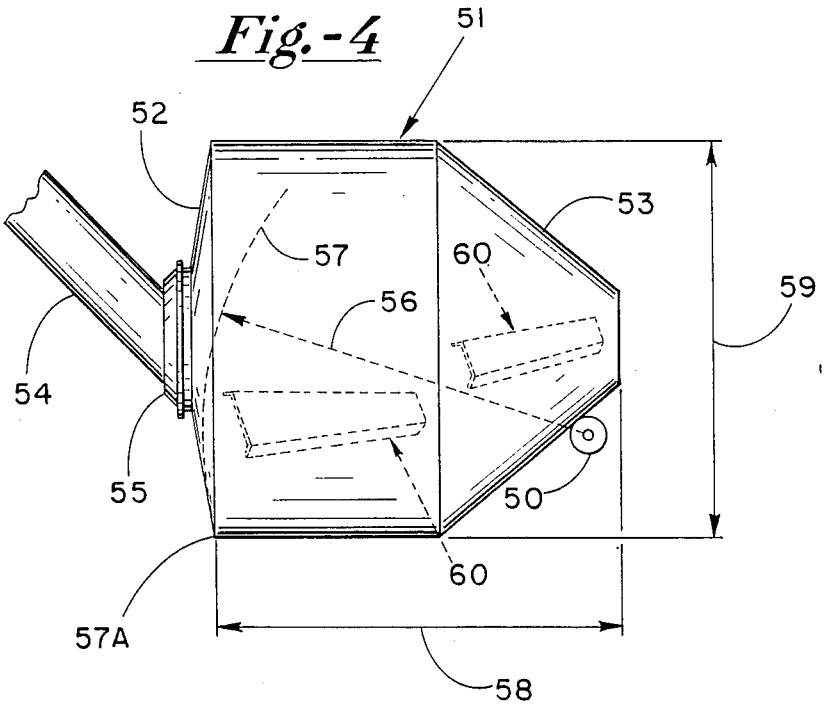
FIG. 4 is a schematic diagram of the drum illustrating certain geometric relations.

The schematic representation of the FIG. 4 is intended to illustrate the minimum cone required for operation of the drum of the invention with respect to a charge chute based on a given forward location of the pivot point or the torque tube 50. In that illustration, a mixing drum 51 including a charge section cone 52 and forward conical section 53 is shown addressing a charging chute 54 located adjacent a charging lip 55. It will be appreciated that as the pivot point illustrated by torque tube 50 approaches the discharge end of the conical section 53 the minimum required radius 56 increases and, therefore, the minimum required depth of the cone 52, for the critical corner point 57*a* on the arc 57 to clear the loading chute decreases. If the point 57*a* is located on the arc 57, the drum 51 will just clear the charge chute at all points. The relative length 58 and diameter 59 are also illustrated.

Figure 5A:
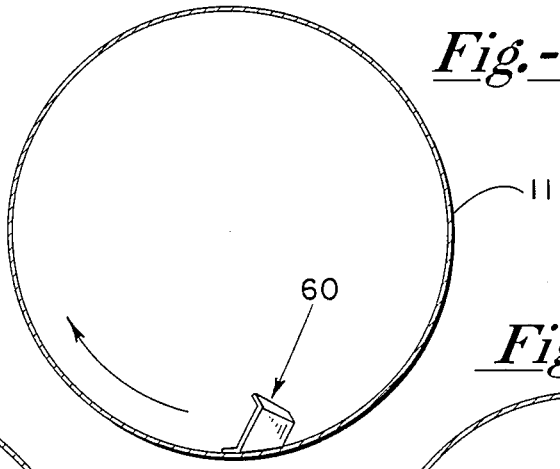
FIGS. 5A, 5B and 5C illustrate the relative rotational position of one central zone mixing blade as seen from the charge end of the mixer.
Figure 5B:
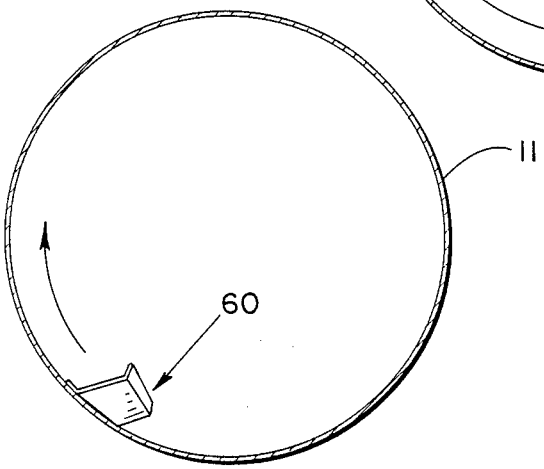
Figure 5C:
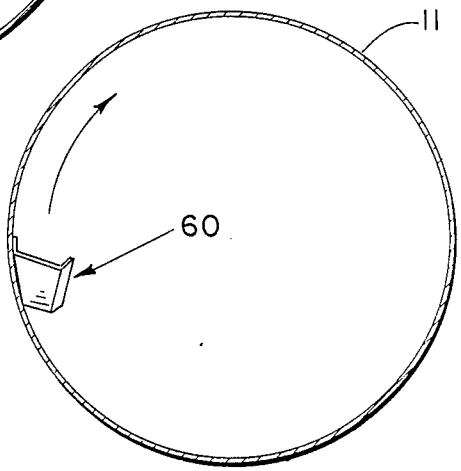

FIGS. 5A, 5B and 5C represent schematic views of the positional relationship of one of six central mixing central blades 60 attached to the inside of the mixing drum wall at an angle with the wall varying from about 90° at the charging end to about 45° at the narrow mixing end. The blades then are represented as they would appear being viewed from the charging end looking toward the central section of the mixer.

Figure 7A:
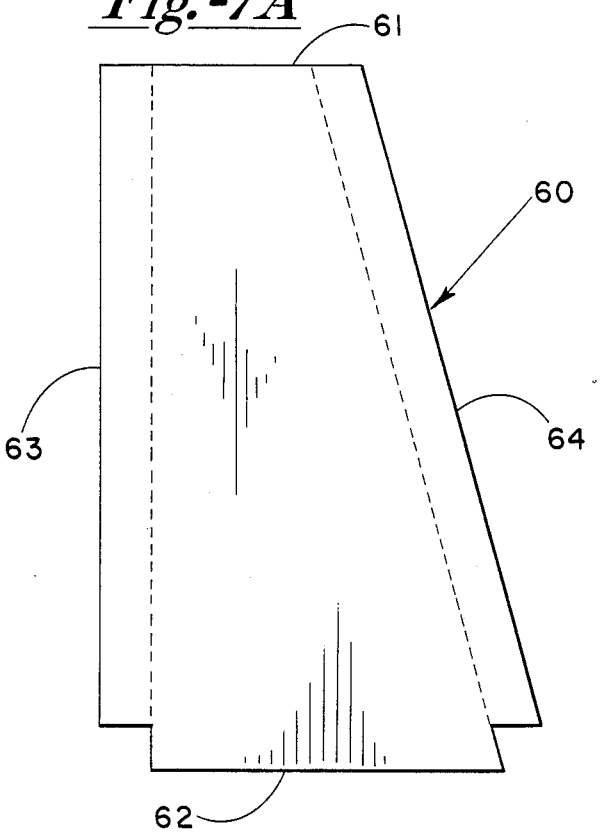
FIGS. 7A, 7B and 7C illustrate a typical mixing blade in accordance with the invention.
Figure 7B:
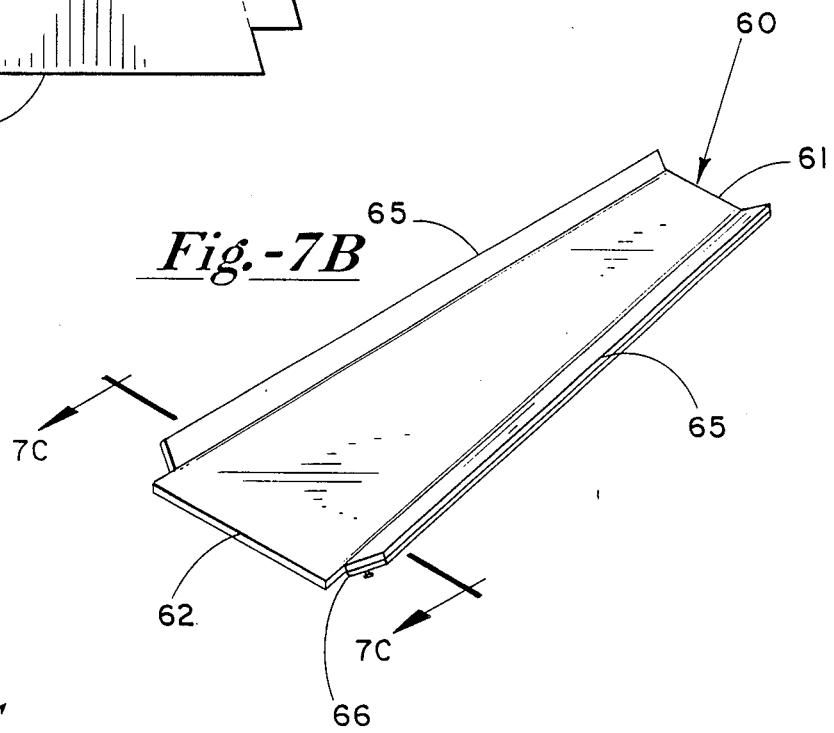
Figure 7C:
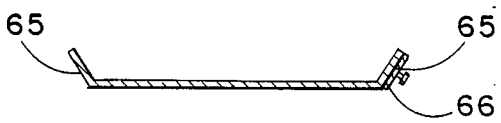

As better seen in FIGS. 7A, 7B and 7C, the representative blade 60 is a quadrilateral in the shape of an elongated trapezoid having a pair of oppositely disposed shorter parallel sides of unequal length 61 and 62 joined by longer nonparallel sides 63 and 64. As shown at 65 in FIG. 7B, the blades are generally scoopshaped in cross section with the scoop designed to be mounted so as to face the direction of rotation of the mixing drum. Reversible, adjustable edge lines 66 may be provided on the blades to reduce wear. The mixing blades in the central mixing section of the drum are preferably six in number, symmetrically distributed about the longitudinal axis of the drum and fixed to the drum wall at an angle with the longitudinal axis and, in addition, at an angle with the wall to which they are fixed which gradually changes from about 45° for the end furthest into the mixing zone to a full perpendicular of 90° angle at the charging end. The trapezoidal shapes are disposed such that the longer of the parallel sides of the trapezoid is closest to the charging end of the drum.

The combination of the variable mounting angle with the location of the wider end at the charging end increases the mixing efficiency at the rear of the mixer. As the drum turns, with its longitudinal axis substantially horizontal, each blade, in turn, scoops up material; the length-varying mounting angle of the blade causes the material to slide toward the central mixing zone. However, because the blade narrows as the mass slides forward into the mixing zone, part of the mass is spilled along the entire length of the blade. This combination produces a general movement of material circulating from the charging end into the mixing zone which increases the efficiency of end-to-end mixing in addition to mixing across the diameter of the drum.

Figure 6:
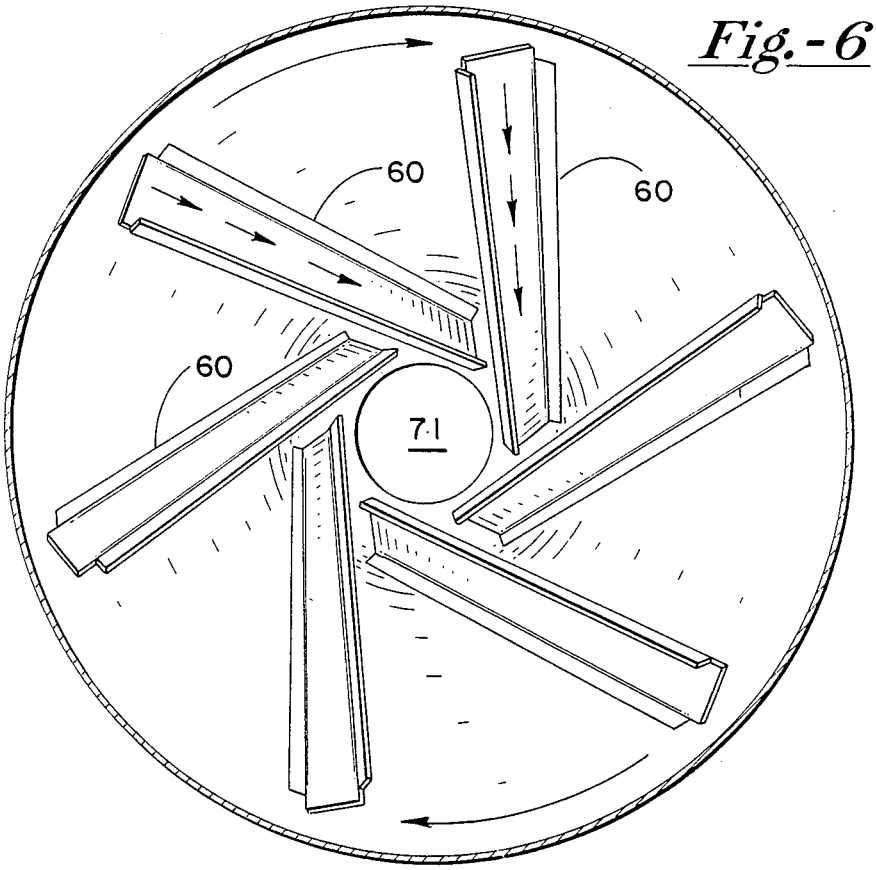
FIG. 6 illustrates a set of blades in the front or cone section of the mixing drum.

FIG. 6 depicts the mounting of the second or forward set of six mixing blades 60 symmetrically disposed about the discharge end or the cone zone including central discharge opening 71. In the preferred embodiment, then, there are six blades located in the first or rearward set of blades in the horizontal or central mixing section of the drum and six blades making up a second forward set of blades located in the cone section of the drum.

The six symmetrically disposed blades in the cone section are preferably of identical shape to those located in the central mixing zone so that only one blade pattern need be used. In the cone they are mounted such that the wide end of the blade or the longer of the shorter parallel sides of the trapezoid is disposed toward the central mixing zone. As previously discussed, the normal disposition of the drum when mixing occurs is with longitudinal axis of the drum disposed in a horizontal plane. As the drum turns, the scoop of each mixing blade, in turn, picks up materials to be mixed during the rotation of the drum and, because of the particular disposition of each of the blades, the materials are caused to generally migrate along the blades toward the discharge end of the cone with part of the material spilling from the blades along this route. The material then is returned toward the central mixing section by gravity, sliding back along the incline of the cone as the drum rotates. This, like the orientation of the blades in the central mixing zone acts to increase the efficiency of end-to-end mixing in the drum.

The blade patterns are preferredly staggered between the front and center or rear mixing sections. The staggering of the blade patterns further provides pockets that the recirculating mix can occupy as it returns to the mixing zone.

The mechanically operated integral dust hood mounted on the conical section 13 is designed to minimize the escape of dust from the system when the dry ingredients to be mixed are charged into the drum from the chute and when the drum is operated in the horizontal plane during the initial stage of mixing. The dust hood remains closed when dust from the dry ingredients, principally from finely divided Portland cement is present in the mixer, i.e. before the water is distributed in the mix. After the batch is mixed, the mixer is tilted as shown in FIG. 2 for discharge. In coordination, the dust hood is moved upward by the cylinder piston 37 and crank arm 38 to a position covering the two-piece discharge chute.

What is claimed is:

1. An improved tiltable rotating mixing drum for mixing erosive materials comprising:

a relative flat rear conical charging zone having a central change opening for receiving materials to be mixed from a charging chute;

a front conical zone having a central discharge opening therein for discharging mixed materials;

a generally cylindrical central zone disposed between said front and rear conical zones;

a first set of mixing blades disposed in said central zone fixed to the wall of the drum, said blades being substantially configured in the shape of elongated trapezoidal scoops with the longer of the parallel sides disposed toward the charging opening of the drum, said blades being further mounted at an angle with but generally symmetrical with respect to the longitudinal axis of the drum and at a varying angle with respect to the drum wall such that as the drum turns in a generally horizontal position the materials being mixed spill from the scoops along the length of the blades and are generally propelled from the charge end toward the central portion of the drum; and a second set of mixing blades disposed in the front conical section of the mixer fixed to the wall thereof, said blades being of a substantially similar shape to those in said first set, said blades being symmetrically disposed about said central discharge opening with the longer of said parallel sides disposed toward said central zone, said second set of blades being mounted at an angle with the longitudinal axis of said drum and at a varying angle with respect to the drum wall such that as the drum turns about a generally horizontal axis the materials being mixed will generally be propelled into the cone falling thereafter back toward said central zone.

2. The mixing drum of claim 1 wherein the angle between the blades of said first set and said drum wall varies from about 90° to about 45° along the length of each blade.

3. The mixing drum of claim 2 wherein the reduced angle between the blades and the drum occurs at the blade end located furthest from said charge opening.

4. The mixing drum of claim 3 wherein said number of mixing blades in each of said first and said second sets is six.

5. The mixing drum of claim 4 wherein said central mixing zone is substantially cylindrical.

6. The mixing drum of claim 1 wherein said number of mixing blades in said first and said second sets is six.

7. The mixing drum of claim 1 wherein said central mixing zone is substantially cylindrical.

8. The mixing drum of claim 1 wherein said rear section is in the form of a relatively flat symmetrical cone having a depth just sufficient that the edges clear said charging chute upon elevation of the rear of said drum.

9. The mixing drum of claim 1 wherein the central charge opening is made larger than necessary to accommodate charging to facilitate access to the interior and further comprising a charging opening insert seal removably mounted in said charge opening to reduce the size of the charge opening during operation of the mixing drum.

10. The mixing drum of claim 1 wherein the charging device is a chute which is fixed relative to the charge opening and the rear conical charging zone is in the form of a relatively flat symmetrical cone having a depth just sufficient for the lower edge to clear the charging chute upon elevation of the rear of the drum during discharge.

11. The mixing drum of claim 1 further characterized by an overall length to diameter ratio which does not exceed 1.15:1.

* * * * *

UNITED STATES PATENT AND TRADEMARK OFFICE

CERTIFICATE OF CORRECTION

PATENT NO. : 4,963,032

DATED : October 16, 1990

INVENTOR(S) : Robert W. Strehlow

It is certified that error appears in the above-identified patent and that said Letters Patent is hereby corrected as shown below:

In column 7, subparagraph 1 of claim 1, line 2, delete "change" and put instead -- charge --.

Signed and Sealed this

Seventeenth Day of March, 1992

*Attest:*

HARRY F. MANBECK, JR.

*Attesting Officer*

*Commissioner of Patents and Trademarks*